US011535409B1

(12) United States Patent
DeMartini

(10) Patent No.: US 11,535,409 B1
(45) Date of Patent: Dec. 27, 2022

(54) PERSONAL LIQUID CANNABIS 6D OIL PRINTER AND SMART CARTRIDGES

(71) Applicant: Richard James DeMartini, Libertyville, IL (US)

(72) Inventor: Richard James DeMartini, Libertyville, IL (US)

( * ) Notice: Subject to any disclaimer, the term of this patent is extended or adjusted under 35 U.S.C. 154(b) by 0 days.

(21) Appl. No.: 17/125,627

(22) Filed: Dec. 17, 2020

Related U.S. Application Data

(60) Provisional application No. 62/949,531, filed on Dec. 18, 2019.

(51) Int. Cl.
*B65B 3/00* (2006.01)
*B65B 3/28* (2006.01)
*B65B 43/60* (2006.01)

(52) U.S. Cl.
CPC ..... *B65B 3/003* (2013.01); *B65B 3/28* (2013.01); *B65B 43/60* (2013.01)

(58) Field of Classification Search
CPC ..... B65B 3/003; B65B 3/28; B65B 43/60
USPC ..... 141/104, 144–148
See application file for complete search history.

(56) References Cited

U.S. PATENT DOCUMENTS 3,572,552 A * 3/1971 Guinn ..... G01F 11/08 222/263
3,941,130 A * 3/1976 Tibbs ..... A61M 5/2033 604/136
4,949,215 A * 8/1990 Studtmann ..... H01H 47/325 361/154
5,111,855 A * 5/1992 Boeck ..... B01F 13/1055 141/103
5,160,327 A * 11/1992 Stines ..... A61M 25/104 604/224
5,314,825 A * 5/1994 Weyrauch ..... G01N 35/00663 356/246
5,472,113 A * 12/1995 Shaw ..... A61J 7/0084 221/15
5,609,268 A * 3/1997 Shaw ..... A61J 7/0084 221/2
6,162,030 A * 12/2000 Pierrat ..... F04B 27/0472 417/497
6,273,298 B1 * 8/2001 Post ..... B01F 13/1058 222/105
6,352,861 B1 * 3/2002 Copeland ..... B01F 5/0057 141/130
6,412,658 B1 * 7/2002 Bartholomew ..... A45D 44/00 141/104
6,457,496 B1 * 10/2002 Chuang ..... B01F 13/1058 141/100
6,586,898 B2 * 7/2003 King ..... H02P 6/182 318/400.04
6,607,013 B1 * 8/2003 Leoni ..... B67D 1/0041 141/104

(Continued)

*Primary Examiner* — Timothy L Maust
(74) *Attorney, Agent, or Firm* — Charles T. Riggs, Jr.

(57) ABSTRACT

A liquid *cannabis* blending and dispensing oil printer system. The 6D Liquid *Cannabis* Printer (6 cartridges) enables a user to create and save a unique blend of *cannabis* oils (THC, CBD terpenes, etc.) online, based on their cartridge set, and print it to the 6D oil printer at home via proprietary print driver. By enabling the user the ability to select and load the unit with personal favorites (THC, CBD terpenes, etc.), the 6D oil printer offers infinite combinations. This empowers users with a variety of combinations to accommodate the wide range of personal formulas and or recipes as desired.

20 Claims, 6 Drawing Sheets

(56) References Cited

U.S. PATENT DOCUMENTS 6,857,453 B2 * 2/2005 Nishino ..... G01G 17/06 141/144
6,991,004 B2 * 1/2006 Kaufhold ..... B01F 13/1055 141/104
7,028,726 B2 * 4/2006 Feygin ..... B01F 13/1058 141/144
7,311,223 B2 * 12/2007 Post ..... B01F 15/00194 222/1
7,347,344 B2 * 3/2008 Engels ..... B01F 13/1058 222/1
8,147,447 B2 * 4/2012 Sundar ..... A61M 5/172 604/67
8,176,950 B2 * 5/2012 Luchinger ..... G01G 13/02 141/83
8,201,592 B2 * 6/2012 Van Vreeland ... B01F 15/00253 141/94
8,286,671 B1 * 10/2012 Strangis ..... B65B 7/28 141/9
8,372,045 B2 * 2/2013 Needle ..... A61M 5/1454 604/246
8,479,365 B2 * 7/2013 Tubota ..... B23P 19/02 29/240
8,584,714 B2 * 11/2013 Gaultney ..... B29B 7/78 141/83
8,944,291 B2 * 2/2015 Sassatelli ..... G01F 11/021 222/148
8,993,058 B2 * 3/2015 Anthis ..... H01L 21/28264 427/255.31
9,393,388 B2 * 7/2016 Seaver ..... A61M 27/006
10,549,247 B2 * 2/2020 Schwartz ..... B01F 15/00025
10,865,440 B2 * 12/2020 Eberhart ..... B01L 3/527
2003/0041916 A1 * 3/2003 Kohashi ..... B67C 3/202 141/83
2013/0200097 A1 * 8/2013 Yang ..... H05K 13/00 222/52
2017/0185746 A1 * 6/2017 Cameron ..... G16H 20/13
2019/0062144 A1 * 2/2019 Greenbaum ..... B67D 7/74

* cited by examiner

PERSONAL LIQUID CANNABIS 6D OIL PRINTER AND SMART CARTRIDGES

FIELD

The present disclosure relates to a personal countertop liquid *cannabis* blending and dispensing "6D" oil printer and cartridge set. The term "61)" refers to the number of cartridges in a preferred embodiment. It should be understood however that the bending and dispensing system and method disclosed herein could have any amount of cartridges which would be suitable for their intended purpose (s).

BACKGROUND

TNC-CBD-Terpenes are sold in dispensaries in states where *cannabis* is medical and/or recreational. A customer can only purchase sealed, pre-packaged products due to current restrictions; however, this makes for a safer product.

Being limited to pre-packaged products is a problem for consumers who want a certain combination of oils and flavoring. Different blends of oil are available, but they cannot currently be customized to a specific combination.

The personal countertop liquid *cannabis* blending oil printer and cartridge set solves this problem by allowing users to purchase various *cannabis* and non-*cannabis* oil cartridges from a local dispensary (or wherever cartridges can be sold legally), load at least 2-6 cartridges in the oil printer, and combine/have access to multiple oil combinations for a custom experience in the home.

This process is similar to ink cartridges in the printing industry, as cartridges are replaced when consumed. This allows a user to choose which oil cartridges to load in the cartridge slots, thus creating a personalized mixing console.

The cartridges are equipped with Smart Cartridge Technology (SCT), which relays machine data to the application running the print command.

It is desired that the presently disclosed product and method be applicable generally to any instances or applications involving the use of liquid *cannabis* and the blending and dispensing thereof.

SUMMARY

The present disclosure relates to a personal desktop or countertop liquid *cannabis* blending and dispensing oil printer and a cartridge set for home use.

The main unit is CPU based and controlled externally via a mobile device or personal computer. The external controlling device would be connected to the oil printer via bluetooth, will, or usb connection. Printer drivers to interpret the mixing instruction set would be available via download from the cloud and installed on a controller CPU.

The external controlling device would run proprietary, cloud-based software and control deign and dispensing instructions via the print driver for the 6D oil printer system, similar to printing a document.

In the embodiment illustrated, the printer holds up to 6 interchangeable smart oil cartridges, each with a capacity range from 1 ml to 10 ml refills. Alternate embodiments can have more or less cartridges. Smart Cartridge Technology is embedded in each cartridge and automatically uploads various attributes when loaded, including but not limited to content type, flavor, strain, analytics, purity and potency to the controlling software.

Smart Cartridge Technology is not only a key source of data acquisition, it also simplifies the cartridge loading process by automatically reading into the system the necessary attributes to create menus and custom blending tool instructions that are unique to that printing station content. The user launches the proprietary mixing software, sets the desirable output mix, and then oil print the mixture into a receiving vessel.

BRIEF DESCRIPTION OF DRAWINGS

A clear understanding of the key features summarized above may be had by reference to the appended drawings, which illustrate the disclosed method and system, although it will be understood that such drawings depict preferred embodiment(s) and, therefore, are not to be considered as limiting its scope with regard to other embodiments which are contemplated and which can be readily understood. Accordingly.

It is to be understood that the teachings herein can be modified for other presently known or future configurations according to the various embodiments described herein.

DETAILED DESCRIPTION

The following description refers to numerous specific details which are set forth by way of examples to provide a thorough understanding of the relevant method(s) and system(s) disclosed herein. It should be apparent to those skilled in the art that the present disclosure may be practiced without such details. In other instances, well known methods, procedures, components, instruments, implements and/or devices have been described at a relatively high-level, without detail, in order to avoid unnecessarily obscuring aspects of the present disclosure.

In describing the method and system disclosed herein, it will be understood that a number of techniques and steps are disclosed. Each of these have individual benefits, and each can also be used in conjunction with one or more (or in some cases all) of the other disclosed techniques. Accordingly, for the sake of clarity, this description will refrain from repeating every possible combination of the individual steps in an unnecessary fashion: nevertheless, the specification and any claims should be read with the understanding that such combinations are entirely within the scope of the claims herein.

The present disclosure is to be considered as an exemplification of the method and system and is not intended to be limited to specific environments illustrated by the figures for description below.

The present invention will now be described by referencing the appendage figures representing preferred environments.

Figure 1:
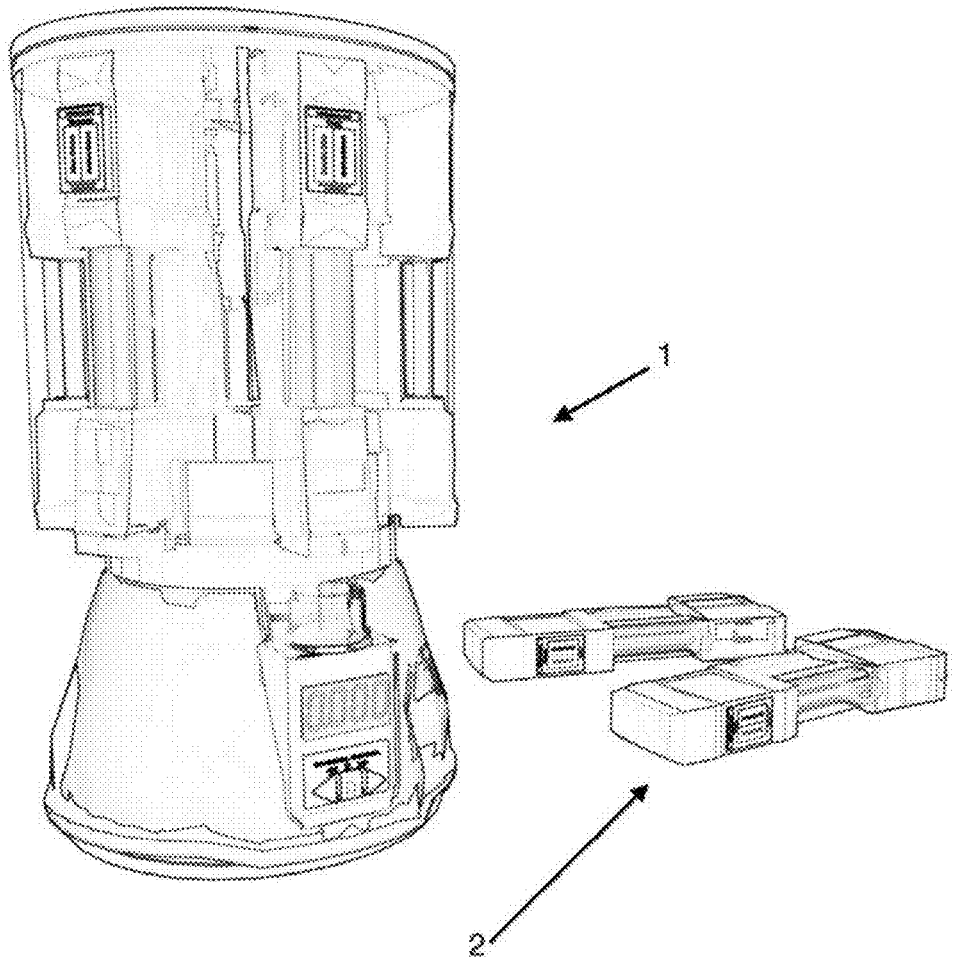
FIG. 1 shows an image of a perspective view illustrating a preferred embodiment of the GD printing system with interchangeable Smart Cartridges according to the various embodiments described herein.

FIG. 1 shows a perspective view illustrating a preferred embodiment of the preferred 6D Liquid *Cannabis* Printer, showing a standalone main base unit loaded with 6 Smart Cartridges (1) along with extra interchangeable Smart Cartridges (2). The 6D *cannabis* printer would be set up like any personal USB printer. The personal computer, although not shown in diagram, would need to run the printer's proprietary mixing software; however, the printer can be controlled manually if set up accordingly. The illustration also shows replacement inventory syringe container Smart Cartridges and a dab jar as a receiving vessel.

Figure 2A:
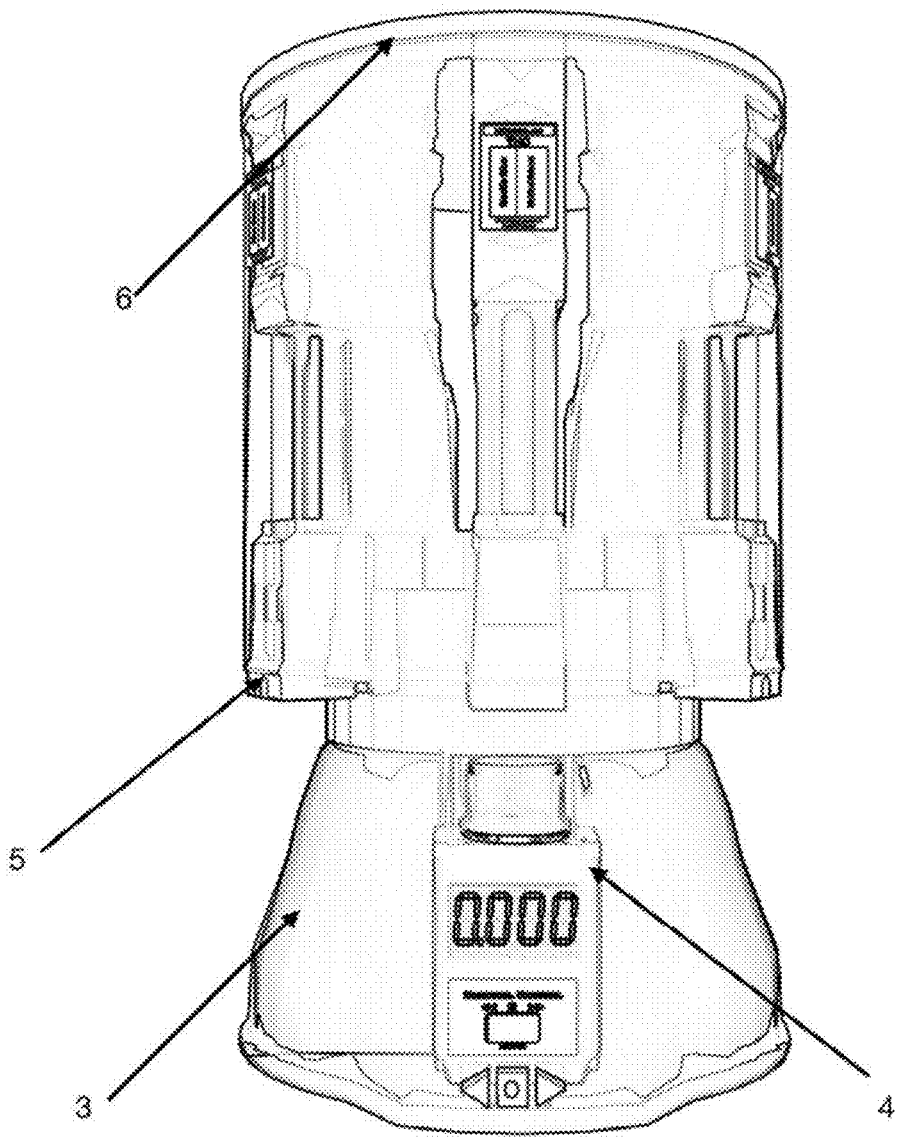
FIG. 2A shows a front view illustrating a preferred embodiment of the 6D printing system with interchangeable Smart Cartridges according to the various embodiments described herein.

FIG. 2A shows a front view illustrating a preferred embodiment of the 6D Liquid *Cannabis* Printer, showing a standalone unit loaded with Smart Cartridges. It consists of a base (3), scale housing (4), a set of six Smart Cartridges (5), and security lid and clear visor covering the cartridges (6).

Figure 2B:
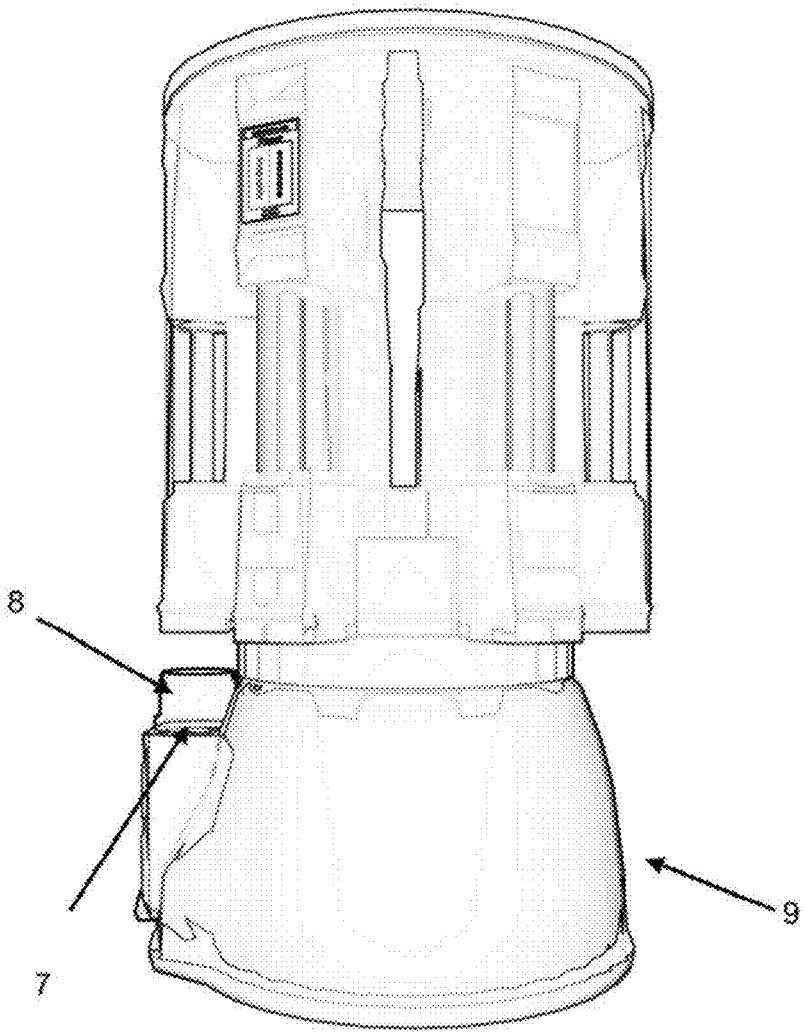
FIG. 2B shows a side view illustrating a preferred embodiment of the 6D printing system with interchangeable Smart Cartridges according to the various embodiments described herein.

FIG. 2B shows a side view illustrating a preferred embodiment of the 6D Liquid *Cannabis* Printer, showing a standalone main base unit loaded with six Smart Cartridges. The sick view in a preferred embodiment also shows the output scale platter (7) holding the requested receptacle types, such as but not limited to vape cartridges, dab jars, and custom vials of various sizes (8). In the rear of the base are connections tier a USB interface and 12-volt power supply (9). Power supply not shown. Power requirements are a 12-volt dc regulated 20-amp power supply.

Figure 3:
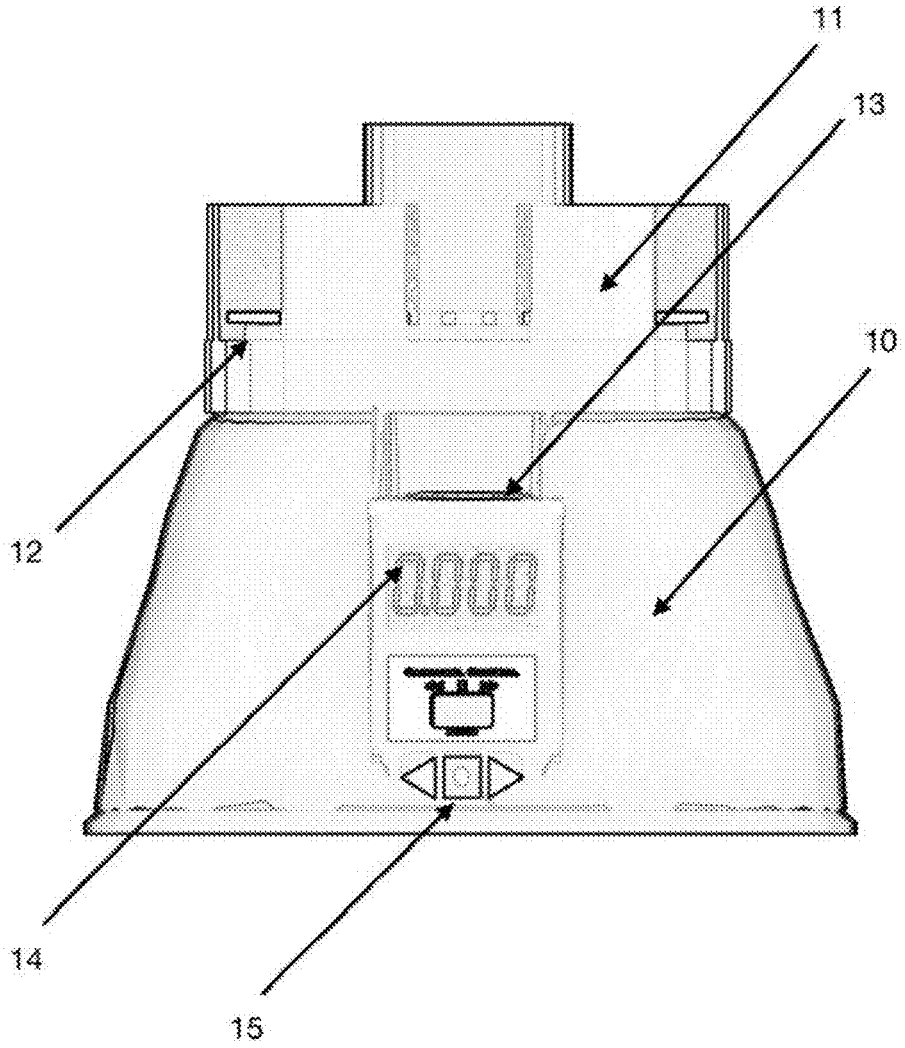
FIG. 3 shows a front view illustrating a preferred embodiment of the 6D printing system main base station without interchangeable smart cartridges according to the various embodiments described herein.

FIG. 3 both illustrates and describes the basic components of the 6D Liquid *Cannabis* Printer system. The preferred embodiment of the main housing for the 6D Liquid *Cannabis* Printer desktop lower base unit (10) is designed to be made out of quality plastic and injection molded for easy cleaning and maximum durability. The unit's preferred measurements would be 9" wide x 9" deep x 9" high but may vary with features and new requirements. The rotor head housing (11) is form fitted to hold a set of six individually selected Smart Oil Cartridges (5). Each of the six slots has a female socket with electrical contacts the ground, trigger power, firmware and intelligent lighting (12). The rotor head is mounted to a 5:1 geared ratio powered by a stepper motor mounted in the lower base unit (10). The stepper motor is driven via instructions from a micro controller managed by external printer scripts. The scripts dictate which cartridge to position over the scale platter (13) for dispensing. The LED readout (14) references the weight of the oil dispensed and is in a loop with the cartridge trigger to ensure the amount dispensed is accurate to the instructions in the print script. The manual navigation buttons for carousel drive override (15) are typically used to manually rotate the carousel in two different positions. There are three buttons, including a left button which increments the carousel left and a right button which increments the carousel to the right. There is also a status button. The status button informs the user when the carousel is lined up properly and ready for filling.

Figure 4:
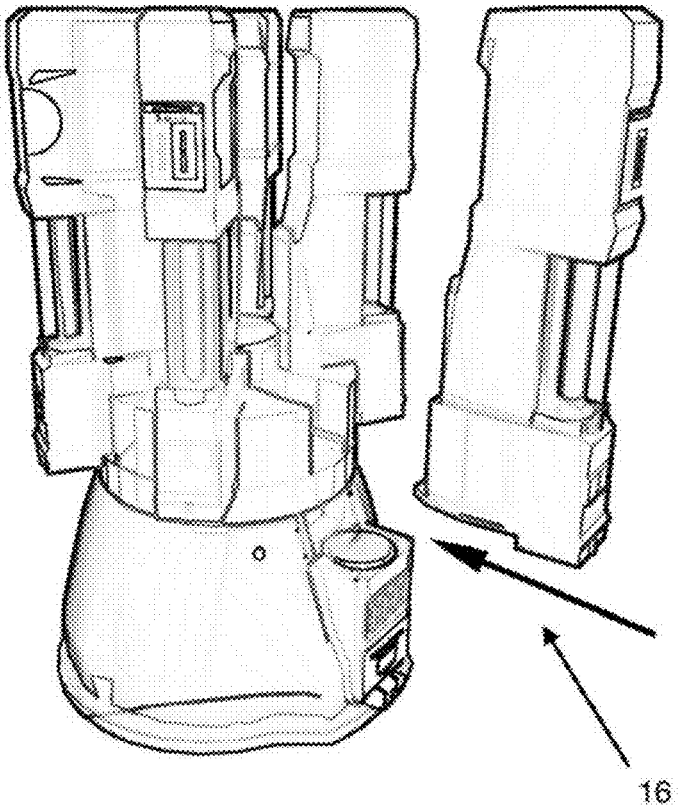
FIG. 4 is a diagram illustrating a preferred embodiment of the 6D printing method and system depicting the loading of a smart cartridge into the main base station.

FIG. 4 is a perspective view diagram showing a preferred embodiment of the method and system depicting the cartridge loading and reloading process. The direction arrow (16) indicates the direction a new or replacement cartridge is loaded in to the rotor head (11).

Figure 5A:
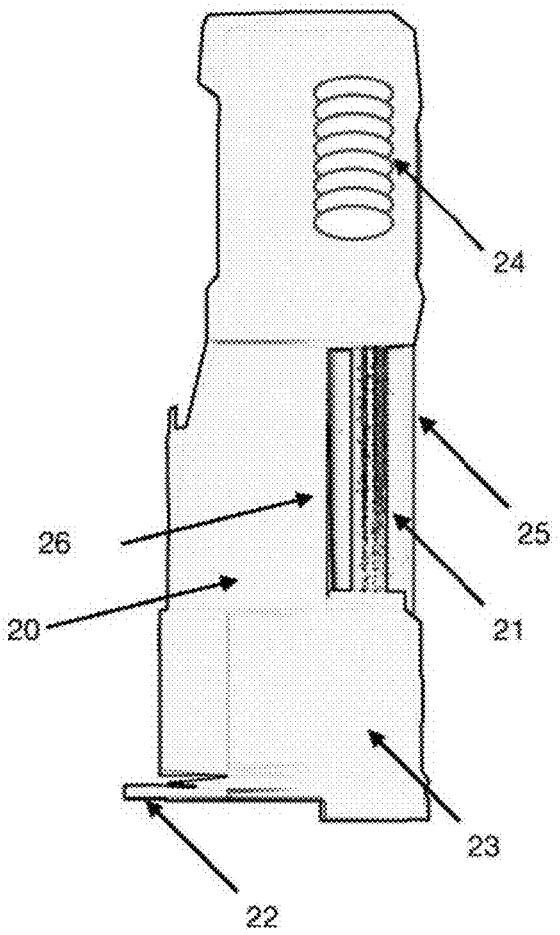
FIGS. 5A and 5B shows a side view and a front view respectively illustrating a preferred embodiment of the 6D printing system smart cartridge according to the various embodiments described herein.
Figure 5B:
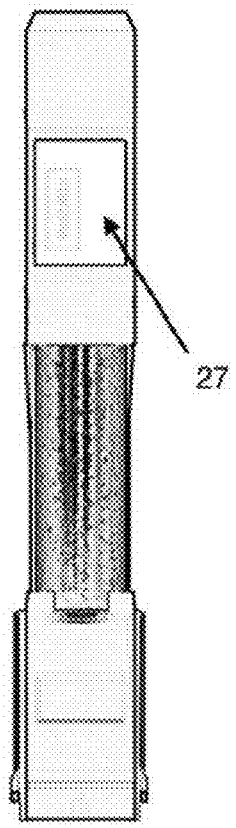

FIGS. 5A and 5B shows both a side view and a front view illustrating a preferred embodiment of the 6D Liquid *Cannabis* Printer Smart Cartridge plastic housing (20). Each cartridge has a unique id and dataset representing the oil makeup within the cartridge dispenser syringe (21). The attributes are embedded as firmware (22) within cartridge male plugs and connected when loaded in the rotor head (11). These values can be read through the rotor head when a cartridge is in use and uploaded to a central server for analytics and/or data acquisition. In the base of the cartridge, there is a 12-volt 5 ms solenoid valve (23) connected to trigger logic instructed by the print script. Each trigger accurately dispenses small portions of oil until the destination weight is reached. Destination weight is measured and controlled by a scale and logic system which sets the desired weight. The system triggers the solenoid with high speed pulses via a MOSFET switch until the weight amount is reached. The MOSFET is a four-terminal device with source (S), gate (G), drain (D) and body (13) terminals. The body of the MOSFET is frequently connected to the source terminal, making it a three-terminal device like a field effect transistor. The dispenser syringe (21) is set into a spring pressure system (24) which produces constant pressure to keep the syringe firing steady. The dispenser syringe (21) is protected by a clear, high impact plastic tube (25) for security and safety. There is a built-in led light (26) for firing status mounted behind the dispenser syringe (21) body for visual status when firing. On the front of the cartridge, there would be a label (27) with required data exposed to the user.

Accordingly, the method and system features a countertop or desktop liquid *cannabis* blending and dispensing home system. The liquid *cannabis* oil printer can be controlled either manually or through personal computer software connected via print driver. The method and system uses a print driver that enables personal computers to connect and control liquid *cannabis* oil printing dispenser. The liquid *cannabis* oil printer includes interchangeable Smart Cartridges. The liquid *cannabis* oil printer uses Smart Cartridge Technology firmware.

It is to be understood that the teachings herein can be modified for other presently known or future configurations according to the various embodiments described herein.

While the present disclosure has been described in terms of particular embodiments and applications, in both summarized and detailed forms, it is not intended that these descriptions in any way limit its scope to any such embodiments and applications, and it will be understood that many substitutions, changes and variations in the described embodiments, applications and details of the method and system illustrated herein and of their operation can be made by those skilled in the art, without departing from the spirit of this invention.

What is claimed is:

1. A liquid *cannabis* blending and dispensing device comprising:

a base;

a scale housing having a scale therein;

a set of liquid *cannabis* cartridges, each cartridge having a dispenser syringe and a constant pressure spring system for asserting a constant pressure on the dispenser syringe, and a solenoid in a base of the cartridge for controlling dispensing of liquid *cannabis* from the liquid *cannabis* cartridges;

a rotor head housing having a set of cartridge docks, each cartridge dock configured to receive one cartridge of the set of liquid *cannabis* cartridges;

a stepper motor for driving the rotor head housing; and a scale platter;

wherein each cartridge includes firmware embedded within cartridge male plugs, and wherein each cartridge dock includes a female socket with electrical contacts.

2. The device of claim 1, wherein the syringe is housed in a plastic tube.

3. The device of claim 1, wherein the syringe is replaceable.

4. The device of claim 1, wherein the stepper motor is configured to be driven based upon instructions from a microcontroller.

5. The device of claim 4, wherein the microcontroller is configured to receive instructions from external print scripts.

6. The device of claim 1, further comprising a MOSFET switch for triggering a 5 milliseconds solenoid to control dispensing from the liquid *cannabis* cartridges.

7. The device of claim 1, wherein each cartridge is interchangeable.

8. A method of blending and dispensing liquid *cannabis* comprising the steps of:

loading cartridges each having a dispenser syringe, a constant pressure spring system, and a solenoid in a base of the cartridge, into a rotor head housing having a set of cartridge docks, each cartridge dock configured to receive one of the cartridges;

embedding firmware within cartridge male plugs on each cartridge prior to loading;

reading the firmware though a female socket with electrical contacts in each cartridge dock;

selectively rotating the cartridges to a scale platter on a scale via a stepper motor; and selectively dispensing liquid *cannabis* from the cartridges.

9. The method of claim 8, wherein the syringe is housed in a plastic tube.

10. The method of claim 8, wherein the syringe is replaceable.

11. The method of claim 8, further comprising the step of driving the stepper motor via instructions from a microcontroller.

12. The method of claim 11, further comprising the step of providing instructions to the microcontroller from external print scripts.

13. The method of claim 8, further comprising the step of controlling dispensing from the liquid *cannabis* cartridges via a MOSFET switch for triggering the a 5 milliseconds solenoid.

14. An oil printing system for blending and dispensing liquid *cannabis*, comprising:

a scale housing having a scale platter mounted on a scale;

a rotor head housing operatively positioned above the scale housing, wherein the rotor head housing has a set of cartridge docks, each cartridge dock configured to receive one cartridge of a set of liquid *cannabis* cartridges;

wherein the set of liquid *cannabis* cartridges are selectively positionable in the rotor head housing, and wherein each of the liquid *cannabis* cartridges having a dispenser syringe, a constant pressure spring system for asserting a constant pressure on the dispenser syringe, and a solenoid in a base of the cartridge for controlling dispensing of liquid *cannabis* from the liquid *cannabis* cartridges, wherein the syringe holds a liquid *cannabis;* a stepper motor for driving the rotor head housing;

a MOSFET device and a solenoid for selectively dispensing the liquid *cannabis* from the syringe;

wherein each cartridge includes firmware embedded within cartridge male plugs, and wherein each cartridge dock includes a female socket with electrical contacts.

15. The system of claim 14, wherein the syringe is housed in a plastic tube.

16. The system of claim 14, wherein the syringe is replaceable.

17. The system of claim 14, wherein the stepper motor is configured to be driven based upon instructions from a microcontroller.

18. The system of claim 17, wherein the microcontroller is configured to receive instructions from external print scripts.

19. The system of claim 14, wherein each cartridge is interchangeable.

20. The system of claim 14, wherein the solenoid is a 5 millisecond solenoid.

* * * * *